United States Patent [19]

Kuchuris

[11] Patent Number: 4,546,340

[45] Date of Patent: Oct. 8, 1985

[54] ELECTRICAL COIL ASSEMBLY

[75] Inventor: George F. Kuchuris, Bloomingdale, Ill.

[73] Assignee: The Singer Company, Stamford, Conn.

[21] Appl. No.: 635,689

[22] Filed: Jul. 30, 1984

[51] Int. Cl.[4] ..... H01F 15/10

[52] U.S. Cl. ..... 336/192; 336/208

[58] Field of Search ..... 336/192, 198, 208; 310/71, 194

[56] References Cited

U.S. PATENT DOCUMENTS

| | | | |
|---|---|---|---|
| 3,189,772 | 6/1965 | Wingler et al. | 310/162 |
| 3,354,417 | 11/1967 | Davis | 336/198 |
| 3,453,575 | 7/1969 | Davis | 336/192 |
| 3,634,878 | 1/1972 | Davis | 336/192 |
| 3,711,806 | 1/1973 | Flentge | 336/107 X |
| 3,739,312 | 6/1973 | Knebel | 336/208 X |
| 3,939,450 | 2/1976 | Donnelly | 336/208 X |
| 4,105,985 | 8/1978 | Plunkett | 336/192 X |
| 4,363,014 | 12/1982 | Leach et al. | 336/208 X |
| 4,394,637 | 7/1983 | Petroons | 336/192 |
| 4,424,505 | 1/1984 | Yatsushiro et al. | 336/90 |

*Primary Examiner*—Thomas J. Kozma

*Attorney, Agent, or Firm*—David L. Davis; Robert E. Smith; Edward L. Bell

[57] ABSTRACT

An electrical coil assembly includes a bobbin having a pair of generally parallel end plates with a pair of terminals inserted into holes in an edge of one of the end plates. Magnet wire is wrapped around one of the terminals and then wound around the bobbin, with the finish end of the magnet wire being wrapped around the other terminal. A layer of protective insulated tape is applied over the surface of the wound coil and the terminals are dip soldered to the magnet wire. Formed integrally with the bobbin is an upstanding wall mounted on one of the end plates and having a lead wire receiving slot formed therein. A cover member is formed on the other end plate and is connected thereto by a living hinge. Lead wires are soldered to the terminals and inserted in the slot. The cover member is then folded over to mate with the wall so as to cover the terminals and the solder connections. The cover member is formed with a rib which is forced between the lead wires to aid in holding them securely and the cover member is then secured to the wall.

11 Claims, 8 Drawing Figures

ELECTRICAL COIL ASSEMBLY

BACKGROUND OF THE INVENTION

This invention relates to electrical coil assemblies.

It is an object of the present invention to provide an electrical coil assembly whose manufacture is completely automatable.

It is another object of this invention to provide such an assembly with a minimum number of parts.

It is a further object of this invention to provide an extremely reliable electrical coil assembly.

It is yet another object of the present invention to provide such an assembly having a very low cost.

SUMMARY OF THE INVENTION

The foregoing and additional objects are attained in accordance with the principles of this invention by providing an electrical coil assembly comprising a bobbin having a coil receiving central portion and a pair of generally parallel end plates at either end of the central portion defining a coil receiving channel, a wall mounted on an edge of the first of the end plates and extending outwardly from the first end plate generally coplanar therewith, the wall having a certain angular extent and being formed with a notch therein, a pair of terminals mounted on one of the end plates, a coil wound on the central portion of the bobbin within the channel and having a first end connected to a first of the terminals and a second end connected to the other of the terminals, a pair of insulated lead wires each connected to a respective terminal and extending through the notch, and a cover member mounted on the other of the end plates across the channel from the wall and adapted to span the channel to cover the terminals and mate with the notch outwardly from the lead wires.

In accordance with an aspect of the present invention, the cover member is formed with a rib adapted to extend between the lead wires in the notch.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
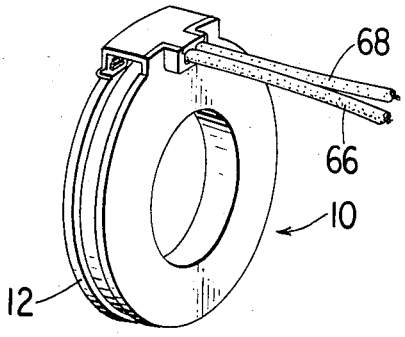
FIG. 1 is a perspective view showing a complete electrical coil assembly according to this invention.
Figure 2:
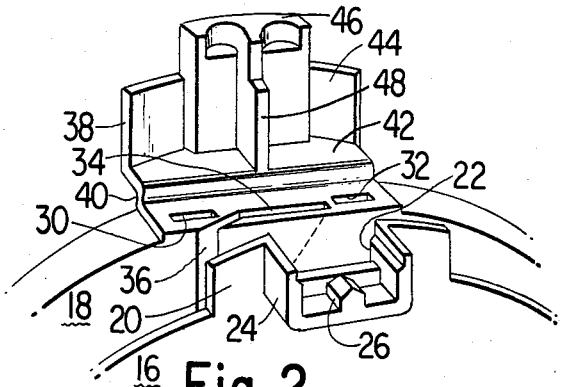
FIG. 2 is an enlarged perspective detail of the wall and cover member portions of the bobbin according to this invention.

The basic component of the electrical coil assembly according to this invention, which assembly is generally designated by the reference numberal 10, is the bobbin 12. The bobbin 12 has a coil receiving central portion 14 and a pair of generally parallel end plates 16 and 18 at either end of the central portion which together define a coil receiving channel. Preferably, the bobbin 12 is formed as a unitary molded plastic piece, illustratively of nylon material. The end plate 16 is formed with a wall 20 extending outwardly therefrom and generally coplanar therewith. The wall 20 is formed with a notch 22 therein. Further formed on the wall 20 is a generally U-shaped channel extension 24 extending axially outward from the wall 20 and aligned with the notch 22. The channel extension 24 is below the level of the end plate 16 and includes a rib 26 extending from the base of the channel extension 24 up to the level of the end plate 16 to define two subchannels within the channel extension 24.

The second end plate 18 is formed with a thickened portion 28 opposite from the wall 20 and having substantially the same angular extent as the wall 20. The thickened portion 28 is formed with a pair of slots 30 and 32 therein, these slots extending generally parallel to the end plate 18. In addition, the thickened portion 28 is formed with a generally triangular shaped slot 34 which extends down to the level of the coil receiving central portion 14 and is open at 36 to the coil receiving channel. The slot 34 is a coil starting slot.

Connected to the thickened portion 28 is a cover member 38. The connection between the cover member 38 and the thickened portion 28 is a thin web 40 which functions as a "living hinge". The cover member 38 is of generally L-shaped configuration and has a back portion 42 and a top portion 44. The top portion 44 is formed with an enlarged region 46 having a rib 48 which is also joined to the back portion 42.

The end plate 18 is further formed with an inner flange 50 and an outer flange 52 connected by a plurality of radially extending ribs 54 which provide structural support.

Figure 3:
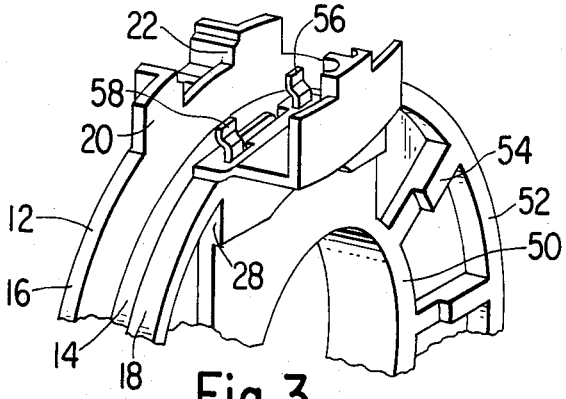
FIGS. 3–8 illustrate the assembly sequence according to this invention.
Figure 4:
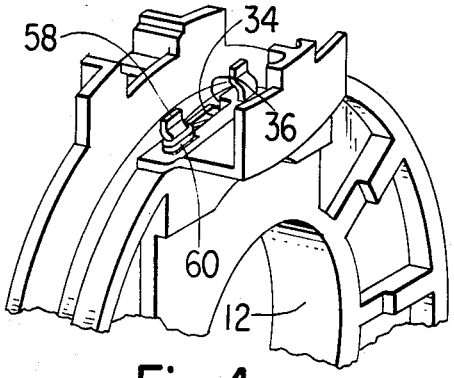
Figure 5:
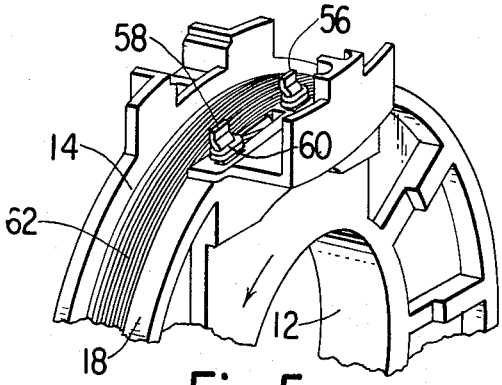
Figure 6:
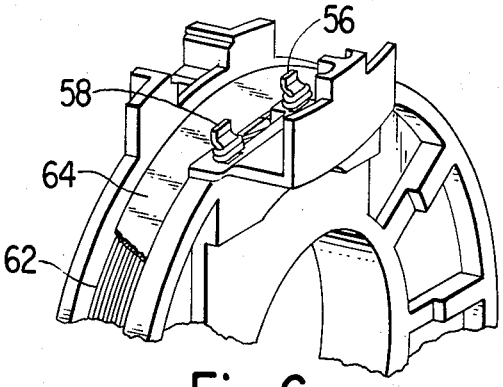
Figure 7:
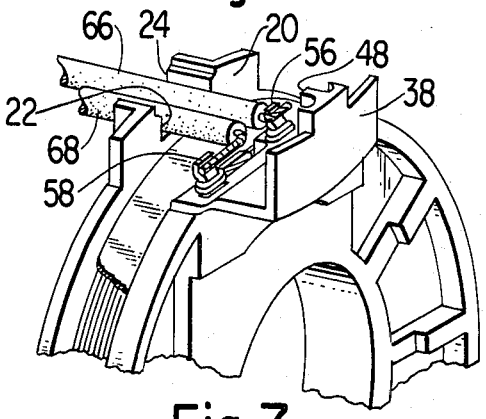
Figure 8:
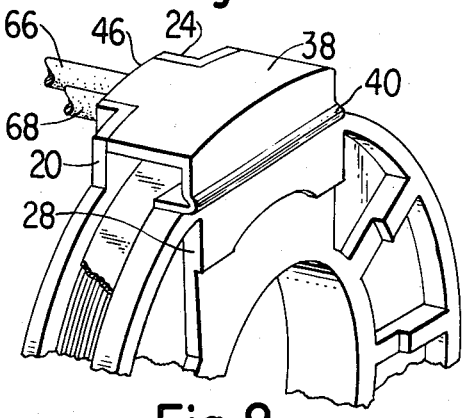

The assembly and construction of the electrical coil assembly 10 will now be described. The terminals 56 and 58 for the coil assembly are formed from rectangular cross section conductive metal stock. Preferably, the terminals 56 and 58 are brass. During assembly, the bobbin 12 is placed on an automatic winding machine and chucked in position. The terminal material is fed from spools, inserted into the slots 30 and 32 and cut to height automatically on the winding machine, resulting in the construction depicted in FIG. 3. Magnet wire 60 is then wrapped around the terminal 58 for two or three turns and is then led into the opening 36 and the slot 34 down to the coil receiving central portion 14, as shown in FIG. 4. The proper number of turns of the magnet wire 60 are wound around the coil receiving central portion 14 of the bobbin 12 evenly with the bobbin rotating in the direction shown by the arrow in FIG. 5. The winding machine is adjusted so that the final turn is close to the end plate 18 and then two or three turns of the second end of the magnet wire are wrapped around the terminal 56, to form a complete coil 62, as shown in FIG. 5. A layer of protective insulated tape 64 is then applied to the surface of the coil 62, as shown in FIG. 6. The terminals 56 and 58 are then dipped in flux sufficiently to wick and prepare the wire 60 and the terminals 56 and 58 for a solder operation. The terminals 56 and 58 are then dipped in solder so as to secure the ends of the magnet wire 60 both mechanically and electrically to the terminals 56 and 58. As shown in FIG. 7, lead wires 66 and 68 are placed in position against the terminals 56 and 58 and a reflow soldering operation secures these connections. Finally, the cover member 38 is folded over to span the coil receiving channel and cover the terminals and the solder connections. The rib 48 is forced between the wires 66 and 68 and forces them outwardly against the sides of the notch 22 and the channel extension 24. As shown in FIG. 8, the enlarged region 46 mates with the notch 22 and channel extension 24 of the wall 20. The cover member 38 is then secured to the wall 20 by being heat staked, cemented, or, preferably, ultrasonically welded.

The foregoing construction possesses a number of advantages. For example, there is only one major molded part, thereby keeping the cost to a minimum. Additionally, the assembly is completely automatable. Furthermore, with the rib 48 causing the lead wires 66 and 68 to be captured securely within the notch 22 and the channel extension 24, there is great resistance to the wires being pulled out.

Accordingly, there has been disclosed an improved electrical coil assembly. It is understood that the above-described embodiment is merely illustrative of the application of the principles of this invention. Numerous other embodiments may be devised by those skilled in the art without departing from the spirit and scope of this invention, as defined by the appended claims. Thus, for example, the terminals could be mounted on the end plate having the wall instead of on the end plate having the cover member. Further, the bobbin need not be circular.

I claim

1. An electrical coil assembly comprising:

a bobbin having a coil receiving central portion and a pair of generally parallel end plates at either end of the central portion defining a coil receiving channel;

a wall integral with an edge of a first of said end plates and extending outwardly from said first end plate generally coplanar therewith, said wall being formed with a notch and a generally U-shaped channel aligned with said notch and extending axially outward from said wall;

a pair of terminals mounted on an end plate of said end plates;

a coil wound on the central portion of said bobbin within said channel and having a first end connected to a first of said terminals and a second end connected to the other of said terminals;

a pair of insulated lead wires each connected to a respective terminal and extending through said notch and said U-shaped channel; and a cover member mounted on the second of said end plates across said coil receiving channel from said wall and spanning said coil receiving channel to cover said terminals and mate with said notch and said U-shaped channel outwardly from said lead wires ,said cover member being formed of one-piece construction with said second end plate and connected thereto by a thin web of material forming a living hinge and being further formed with a rib extending between said lead wires in said notch and said U-shaped channel, said cover member being secured to said wall to close said notch and said U-shaped channel.

2. The assembly according to claim 1 wherein said terminals are mounted on the same end plate as said cover member.

3. The assembly according to claim 1 wherein said coil ends are wrapped around the respective terminals.

4. The assembly according to claim 3 wherein the coil ends are soldered to the respective terminals.

5. The assembly according to claim 1 wherein the lead wires are soldered to the respective terminals.

6. The assembly according to claim 1 further including insulating tape covering the wound coil.

7. The assembly according to claim 1 wherein said second end plate has a thickened portion formed with a pair of holes therein extending generally parallel to said second end plate and wherein each of said terminals is mounted in a respective one of said holes.

8. The assembly according to claim 7 wherein said thickened portion is further formed with a coil starting slot extending to said coil receiving central portion and adapted to receive therein the starting end of wire used to form said coil.

9. A bobbin for an electrical coil assembly constructed as a unitary element and comprising:

a coil receiving central portion;

a pair of generally parallel end plates at either end of the central portion defining a coil receiving channel;

a wall mounted on an edge of a first of said end plates and extending outwardly from said first end plate generally coplanar therewith, said wall having a notch and a generally U-shaped channel aligned with said notch and extending axially outward from said wall; and a cover member mounted on the other of said end plates across said coil receiving channel from said wall and adapted to span said coil receiving channel and mate with said notch and said U-shaped channel, said cover member being formed of one-piece construction with said other end plate and connected thereto by a thin web of material forming a living hinge and being further formed with a rib adapted to extend into and across said coil receiving channel and into said notch and said U-shaped channel when said cover member mates with said notch and said U-shaped channel.

10. The bobbin according to claim 9 wherein one of said end plates has a thickened portion formed with a pair of terminal receiving holes therein extending generally parallel to said one end plate ,said holes being so located that they are covered by said cover member when said cover member spans said coil receiving channel.

11. The bobbin according to claim 10 wherein said thickened portion is further formed with a coil starting slot extending to said coil receiving central portion.

* * * * *